United States Patent [19]

Solheim

[11] Patent Number: 4,621,813

[45] Date of Patent: Nov. 11, 1986

[54] GOLF CLUB SET

[76] Inventor: Karsten Solheim, 501 Wakonda La., Phoenix, Ariz. 85023

[21] Appl. No.: 660,789

[22] Filed: Oct. 15, 1984

[51] Int. Cl.[4] ..... A63B 53/04

[52] U.S. Cl. ..... 273/77 A; 273/169

[58] Field of Search ..... 273/167 A; D21/214, D21/220, 169, 171, 172, 173, 174, 167 F, 77 A

[56] References Cited

U.S. PATENT DOCUMENTS

| | | | |
|---|---|---|---|
| 1,128,288 | 2/1915 | Churchhill | 273/167 A |
| 1,671,956 | 5/1928 | Sime | 273/169 X |
| 2,007,377 | 7/1935 | Link | D21/220 X |
| 2,254,528 | 9/1941 | Hoare | 273/169 |
| 3,655,188 | 4/1972 | Solheim | 273/169 |
| 3,845,955 | 11/1974 | Solheim | 273/167 A |

*Primary Examiner*—George J. Marlo
*Attorney, Agent, or Firm*—Herbert E. Haynes, Jr.

[57] ABSTRACT

A correlated set of golf clubs the heads of which each contain (1) a sole including a trailing edge which is indented toward the striking face a distance of at least 1/16 of an inch, and (2) a lower back surface adjacent the indented trailing edge sloping upwardly and inwardly from the indented trailing edge toward the striking face. This configuration allows the club head material which would otherwise be located in the indented areas to be redistributed in the heel and toe portions of the club heads. The redistributed head materials increases the mass concentrations in the heel and toe areas which improves the resistance to twisting of the club heads upon off-center impacts with a golf ball.

9 Claims, 18 Drawing Figures

GOLF CLUB SET

BACKGROUND OF THE INVENTION

This invention relates in general to golf clubs and more particularly to golf clubs of the type having iron heads for use on tees and in fairways, with the clubs having improved performance in response to laterally off-set impacts, or mishits, with a golf ball.

As is now well understood, although a golfer controls the swing of a golf club, at the time of impact, the club head acts as if it were a free mass moving at a particular velocity. Most of the energy of this moving mass is imparted to the golf ball in about half of a millisecond, with the result being that the ball, which is compressed against the face of the club, will spring clear as it returns to its normal spherical configuration.

An important factor, among others, involved in achieving ideal impacting of a golf ball is that the point of impact on the face of the golf club head should ideally be below the center of gravity of the head, and when this is achieved, the more a golfer can bet the center of gravity of the club head below the center of gravity of the golf ball, the higher the launch angle and the more solid the hit. Many golf club manufactures in the last decade or so have made it easier for a golfer to achieve this objective by forming the golf club heads with what is normally referred to as "sole weighted club heads". By concentrating a relatively large mass of the golf club head in the sole thereof, the center of gravity of the head is lower than it would be otherwise and this makes it easier for a golfer to get the center of gravity of the golf club head below the center of gravity of the golf ball.

Other important factors involved with ideal impacting of a golf ball are, first, that the impact point on the face of the club head should ideally be in alignment with the center of gravity of the club head and with the center of gravity of the golf ball. And, secondly, the face of the club head should be square, i.e., perpendicular, with the intended travel path of the golf ball. More explicitly, proper alignment is achieved when the center of gravity and the impact point of the golf club head and the center of gravity of the golf ball all lie in a single vertical plane. Therefore, a golf club head is considered to be properly aligned and square when the theoretical plane containing those three points is in alignment with the intended travel path of the golf ball. Deviations from the ideal alignment will result in less than a maximum transfer of energy at the time of impact and deviations in squareness will result in the golf ball deviating to one side or the other of the intended travel path.

The following examples are presented to insure a complete understanding of the above discussed alignment and squareness problems. First consider a situation wherein proper alignment is achieved but the golf club head is not square with the intended flight path of the golf ball. In this situation, a maximum amount of energy will be transmitted to the golf ball but the travel path of the ball will be laterally displaced to one side or the other of the intended flight path. In a second example, consider a situation wherein the club head is square immediately prior to impact but proper alignment is not achieved due to the impact point being laterally offset either toward the toe or the heel of the club head. The amount of energy transferred will be less than maximum resulting in a less than solid hit and a loss of distance.

And, the club head will be gyrated, or twisted, to an out of square position as a result of the gyration.

The term gyration, or twisting, are used in here to define a rotation of the club head at the time of impact about an axis which passes through the center of gravity of the club head and is parallel to the axis of the golf club shaft.

It will be appreciated that it can be very difficult even for highly skilled and experienced golfers to achieve perfect alignment and squareness with a high percentage of consistency. Therefore, many golf club manufactures have formed iron golf club heads with relatively large concentrations of mass in the heel and toe of the club head to increase the moment of inertia and thereby maximize energy transfer and resist, or dampen, gyrations resulting from miss-aligned impacting of the golf ball.

Several prior art golf club iron heads have been designed in the general manner discussed above in attempts to achieve optimum gyration dampening characteristics, and the degree of success in achieving this objective varies from one club head design to another. One basic technique used in various ways in several prior art iron golf club heads is to configure the head with a central hollow, or cavity, in the back surface thereof and redistribute the material which would otherwise be in the cavity, in predetermined proportions and predetermined locations on the club heads. Another technique in use is to form relatively smaller cavities in the back surfaces of the club heads, redistribute the cavity material and provide high density weights in predetermined locations in the heel and toe of the club heads.

The gyration dampening characteristics of iron golf club heads depends, along with other design parameters, on the mass of the material that is redistributed or otherwise concentrated in the heel and toe of the club heads, and the specific mass concentration proportions and locations. As mentioned above, the prior art has made several attempts to achieve optimum gyration dampening characteristics.

It would be desirable to provide a new set of golf clubs having iron heads which are configured to provide improved gyration dampening characteristics in comparison to the prior art.

SUMMARY OF THE INVENTION

In accordance with the present invention, iron golf club heads having improved gyration dampening characteristcs are disclosed. This improvement is accomplished by configuring the club heads with a central indentation, or recess, of at least 1/16 of an inch in the trailing edge of the sole of the club heads and in the surface area proximate thereto. The material which would otherwise be in the indentations is redistributed to the toe and heel portions of the club heads so as to increase the mass concentrations in those areas which increases the moment of inertia and thereby provides the improved gyration dampening characteristics of the club heads of the present invention.

In a first embodiment, the club heads are configured to have arcuate indentations in the trailing edge of the sole and the back surface areas proximate thereto. The curved indentation is formed intermediate the toe and heel of the club heads in a manner whereby land areas are provided at the opposite ends of the curved indentations and the indentations are recessed at least 1/16 of an inch relative to a line extending between the land areas.

In a second embodiment, the club heads are formed to have a substantially linearly extending notched indentation in the trailing edge of the sole and the surface areas proximate thereto. The notched indentation is formed intermediate the toe and heel of the club heads to provide land areas at the opposite ends of the notched indentations, and the indentations are recessed at least 1/16 of an inch relative to a line extending between the land areas.

In both of the embodiments, the material which would otherwise be located in the indentations is redistributed, as mentioned above, to the toe and heel portions of the club heads. The material may be redistributed substantially evenly throughout the toe and heel portions, may be concentratingly located in the land areas at the opposite ends of the recessed indentations, or may be divided in a manner which places some of the redistributed material in the land areas with the balance of the material being located at the upper parts of the toe and heel portions of the club heads.

The novel features that are considered characteristic of this invention are set forth with particularity in the appended claims. The invention will be more fully understood from the following description when read in conjunction with the accompanying drawings.

DESCRIPTION OF THE PREFERRED EMBODIMENTS

Figure 1:
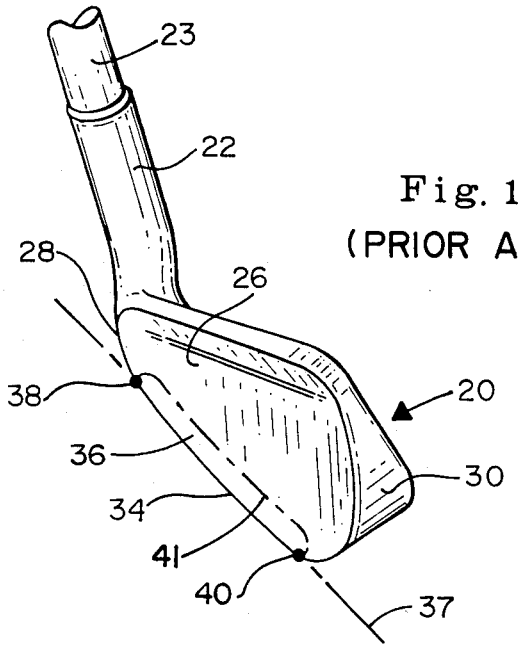
Fig. 1 (PRIOR ART)
FIG. 1 is a perspective view which illustrates a typical configuration of the trailing edge of the sole and adjacent back surface area of a conventional prior art golf club head.
Figure 2:
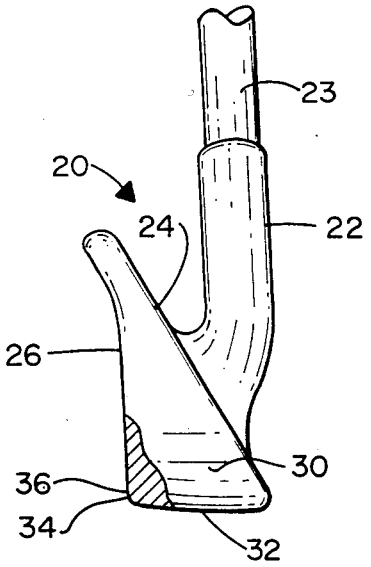
Fig. 2 (PRIOR ART)
FIG. 2 is an elevational view of the toe end of the conventional prior art club head shown in FIG. 1 with a portion thereof being broken away to show the trailing edge of the sole and the adjacent back surface area.
Figure 3:
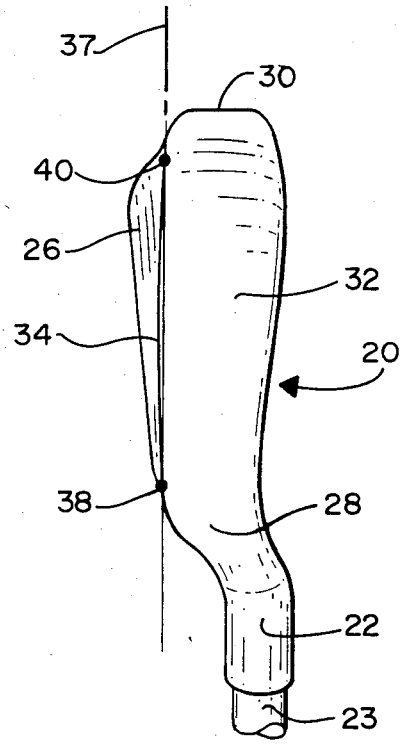
Fig. 3 (PRIOR ART)
FIG. 3 is a bottom view of the conventional prior art club head shown in FIGS. 1 and 2.

Referring more particularly to the drawings, FIGS. 1, 2 and 3 show an iron golf club head 20 which is indicative of conventional prior art club heads. The club head 20 includes the usual hosel 212 connected to the lower end of a shaft 23. The lower end of the hosel 22 is integrally formed with the head proper which includes the impact face 24, back surface 26, heel portion 28, toe portion 30 and the sole 32.

The club head 20 is of the type sometimes referred to as a sole-weighted club in that a relatively large percentage of the mass of the head is concentrated in the sole area 32. As hereinbefore described, sole-weighted club heads are intended to make it easier for a golfer to get the center of gravity of the club head below the center of gravity of the golf ball for ideal impacting thereof.

As seen best in FIG. 1, the back surface 26 of the club head 20 is illustrated as being of substantially planar configuration. The reason for this is that there are so many back surface configurations in prior art golf club heads that no single illustration could possibly be indicative of the various configurations. The various back surface configurations are intended for sole-weighting, heel-toe weighting, and general club head balancing purposes.

However, in all prior art golf club heads known to me, the trailing edge 34 of the sole 32 and the lower back surface area 36 immediately above and coextensive with the trailing edge 34, are substantially linear along their lengths as indicated by the line 37, and in some cases, are of convex curvature. A single exception to this is known to me. In prior iron golf club heads manufactured by me, I provided a slightly indented curvature of the trailing edge of the sole and the adjacent lower back surface area. The indentation that I provided on those prior club heads was about 1/32 of an inch.

To insure a clear understanding of the terms used herein, the trailing edge 34 of the sole 32 is the longitudinally extending junction formed at the intersection of the back surface 36 and the sole 32. And, the trailing edge 34 is further defined as extending from about the point identified at 38 where the curvature of the heel portion 28 blends with the sole 32 to about a point identified at 40 where the curvature of the toe portion 30 blends with the sole. The lower back surface area 36 is the encircled area on the lower end of the back surface 26 which is above and coextending with the trailing edge 34 as indicated by dashed line 41. Of course, the longitudinally extending configuration of the trailing edge 34, i.e., substantially linear or convex in the prior art club heads, will determine, to a great extent, the longitudinally extending configuration of the lower back surface area 36, and vice versa.

Figure 4:
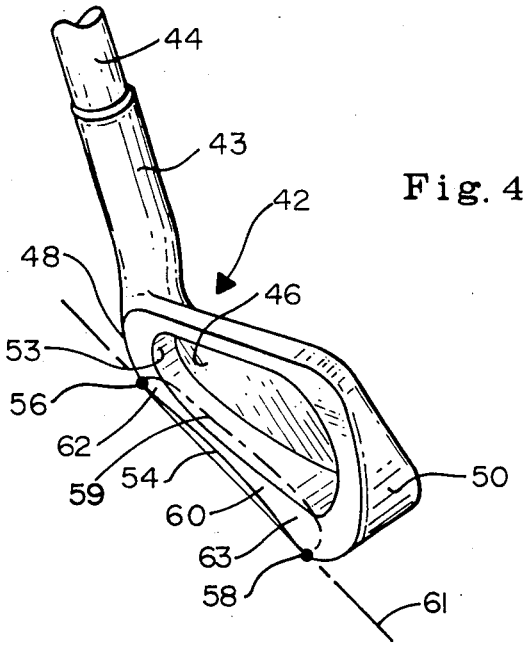
FIG. 4 is a perspective view of a first embodiment of an iron golf club head of the present invention.
Figure 5:
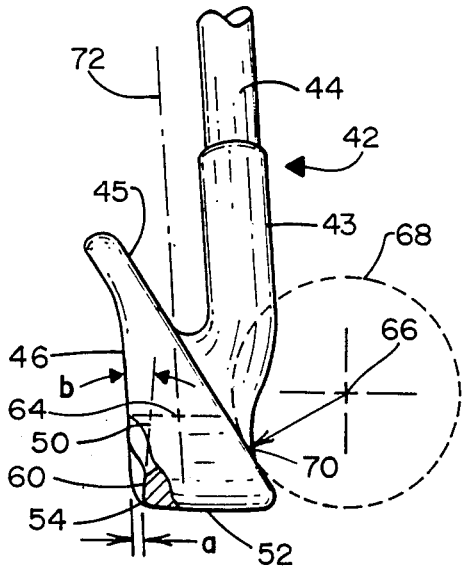
FIG. 5 is an elevational view of the toe end of the club head of FIG. 4 with a portion thereof being broken away to show the trailing edge of the sole and the back surface area proximate thereto, and this figure is provided with a diagrammatically illustrated portion showing various attributes of the club head and the relationships thereof with a golf ball.
Figure 6:
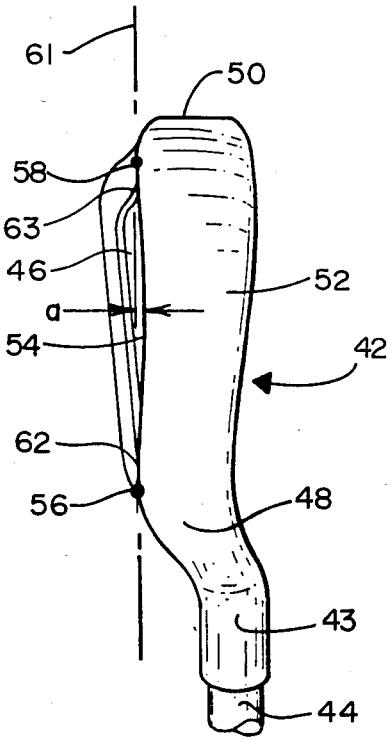
FIG. 6 is a bottom view of the club head shown in FIGS. 4 and 5.

FIGS. 4, 5 and 6 show perspective, toe end elevational and bottom views of a number 5 iron golf club head 42, which is configured in accordance with a first embodiment of the present invention. The club head 42 includes the usual parts and therefore has a hosel 43 connected in a conventional manner to a shaft 44. The hosel is integral with the head proper which has the impacting face 45, back surface 46, heel portion 48, toe portion 50 and the sole 52.

The club head 42 is shown as being of the type referred to as a sole-weighted club head, ad described above, and is further provided with a central recess 53 in the back surface 46. Club heads having a central recess of this sort are sometimes referred to in the art as "cavity-backed" club heads, and this is employed to provide improved club head balancing and resistance to club head twisting resulting from off-center hits, as will hereinafter be described in detail.

The trailing edge 54 of the sole of the club head 42 extends substantially between the points 56 and 58, and the encircled lower back surface area 60, as indicated by dashed line 59, is located immediately above and coextensive with the trailing edge 54. As shown, the trailing edge 54 and the lower back surface area 60 are configured to have an arcuate indentation, or recess, relative to a straight line 61 which contains the two points 56 and 58, with the indentation being at least 1/16 of an inch as indicated at "a", at a substantially central point intermediate the extreme opposite ends 56 and 58 of the trailing edge 54. As seen best in FIG. 6, the opposite ends (no reference numeral shown) of the arcuately indented portion do not extend to the extreme opposite ends 56 and 58 of the trailing edge 54 but rather are spaced inwardly a short distance from the points 56 and 58. This provides a land area 62 in the vicinity of the point 56 and a land area 63 in the vicinity of the point 58 for reasons which will hereinafter be described in detail.

By configuring the club head 42 in this manner, the club head material which would otherwise be in the area of the arcuate indentation, is advantageously redistributed to the heel and toe portions 48 and 50, respectively, of the club head 42. It is preferred that at least portions of the redistributed club head material be located in the above described land areas 62 and 63.

As is known in the art, the center of gravity 64 of the clubh head 42, or any other iron club head, should be below the center of gravity of a golf ball 68 at the time of impact as indicated in FIG. 5. When this is accomplished, the club head 42 will impact the ball 68 at an impact point 70 the exact location of which is controlled by the golfer and is largely determined by the skill of the golfer. When the golf club head is perpendicular to the intended flight path of the golf ball, i.e., square, and the center of gravity 64 of the club head, the center of gravity 66 of the golf ball, and the impact point 70 all lie in an alignment plane which is normal to the impacting face 45 of the club head, a maximum transfer of energy from the club head to the ball will occur. And, the flight path of the ball will be as intended. Deviations in the lateral positioning of the impact point 70 out of the alignment plane, that is toward the toe 50 or heel 48 of the club head, will result in a loss of energy transfer and deviations in the actual flight path of the ball. The loss of energy transfer and flight path deviation is caused by gyrations, or twisting, of the golf club head about an axis 72 which passes through the center of gravity 64 of the club head and is parallel to the longitudinal axis of the golf club shaft 44.

When club head gyrations, resulting from a laterally off-set impacting of a golf ball, the flight path deviations occur as a result of the club head being twisted out of square, that is it will not be perpendicular to the intended flight path of the golf ball. The loss of energy transfer which results from the head gyrations causes a loss in distance of the flight of the golf ball and the loss of energy transfer is a direct result of a loss of inertia.

When iron golf club heads in general are configured with what is referred to as heel-toe balance, what is in actuality the concentration of relatively large percentages of club head mass in the heel and toe, the result is an increase in the moment of inertia, and this dampens, or reduces the gyrations of the club head upon laterally off-set impacting of the golf ball.

By configuring the golf club head 42 in the above described manner, a larger percentage of the total mass of the club head is concentratingly disposed at the heel and toe portions 48 and 50, respectively, than was heretofore possible. This produces an increase in the moment of inertia and thereby further dampens club head gyrations.

Figure 7:
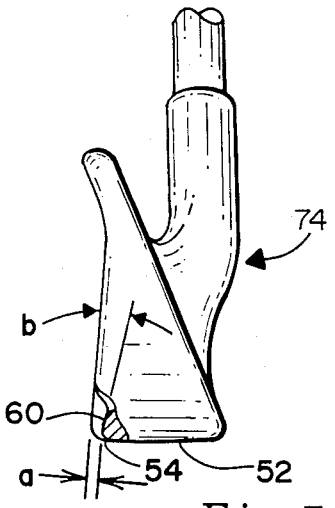
FIGS. 7 and 8 are a toe end elevational view and a bottom view, respectively, of a number 2 iron club head of a correlated set configured in accordance with the first embodiment of the present invention.
Figure 9:
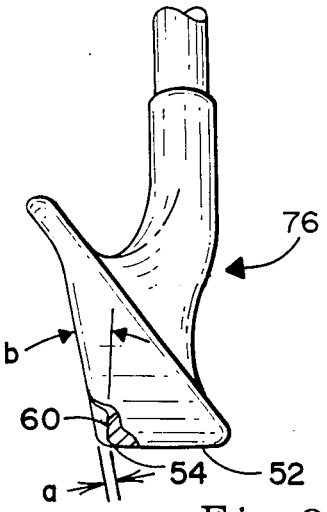
FIGS. 9 and 10 are a toe end elevational view and a bottom view, respectively, of a number 8 iron club head of a correlated set configured in accordance with a first embodiment of the present invention.
Figure 8:
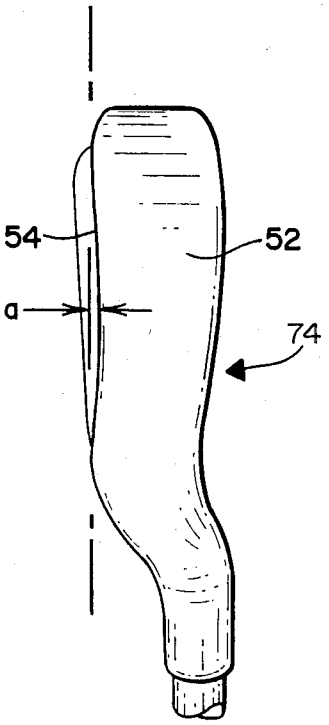
Figure 10:
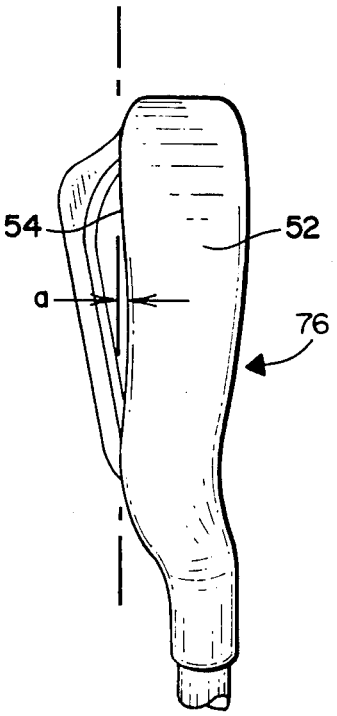

FIGS. 7 and 8 illustrate a toe end elevational view and a bottom view of a number 2 iron golf club head 74 of a correlated golf club set and FIGS. 9 and 10 show similar views of a number 8 golf club head 76 of the correlated golf club set. Each of the heads 74 and 76 are provided with the arcuately indented trailing edge of the sole and adjacent lower back surfaces as hereinbefore described with reference to FIGS. 4, 5 and 6 for a number 5 iron.

Figure 11:
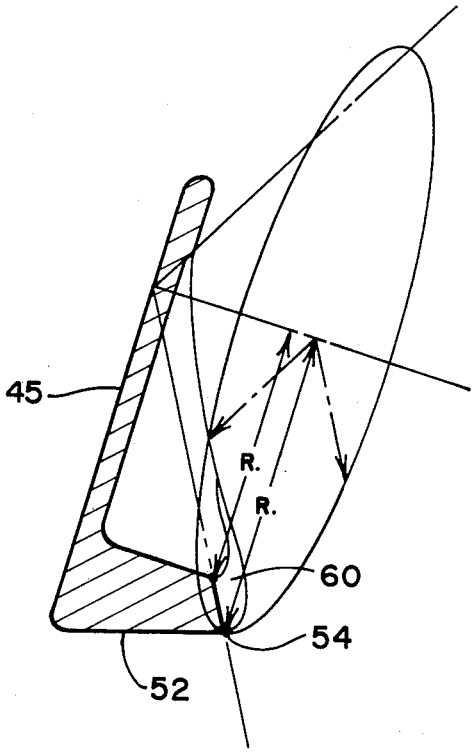
FIG. 11 is a transverse sectional view of the club head of FIGS. 4 through 6 with a diagrammatic illustration showing the configuration of the indented portion of the back surface areas of the club head.

As best seen in FIGS. 5, 7 and 9, each of the club heads 20, 74 and 76 of the correlated golf club set preferably has the lower back surface area thereof sloping inwardly and upwardly from the arcuately indented trailing edge 54 in a direction of the front impacting face of the golf club head to allow further amounts of head material which would otherwise be in those areas to be redistributed as hereinbefore described. These figures clearly show that an acute angle "b" is included between the plane of the back surface of each of these club heads and the inwardly sloping lower back surface areas thereof. Since the lower back inwardly sloping surface area 60 of each club generally follows the arcuately indented trailing edge 54 of the heads, the longitudinal extent of the lower back surface area 60 of each club may be defined as being a truncated segment of an inverted cone as shown diagrammatically in FIG. 11.

Figure 12:
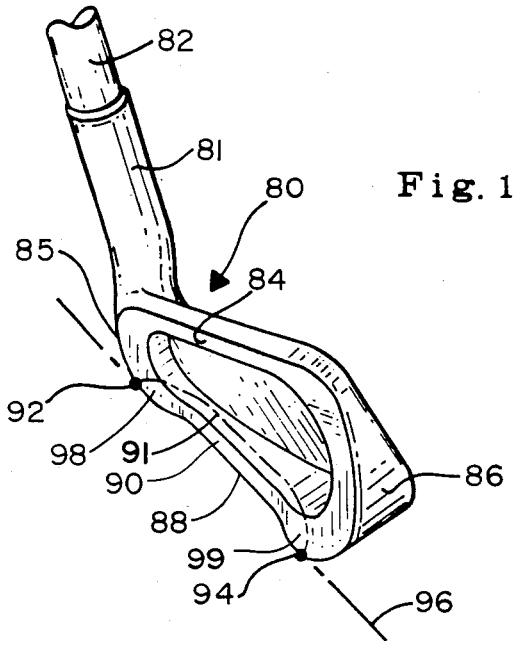
FIG. 12 is a perspective view of a second embodiment of an iron golf club head of the present invention.
Figure 13:
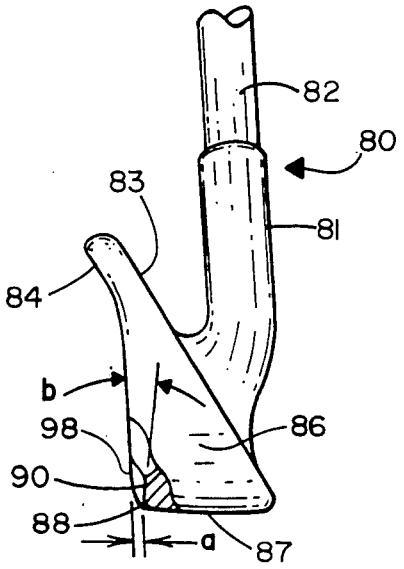
FIG. 13 is an elevational view of the toe end of the club head of FIG. 12 with a portion thereof being broken away to show the trailing edge of the sole and the back surface area proximate thereto.
Figure 14:
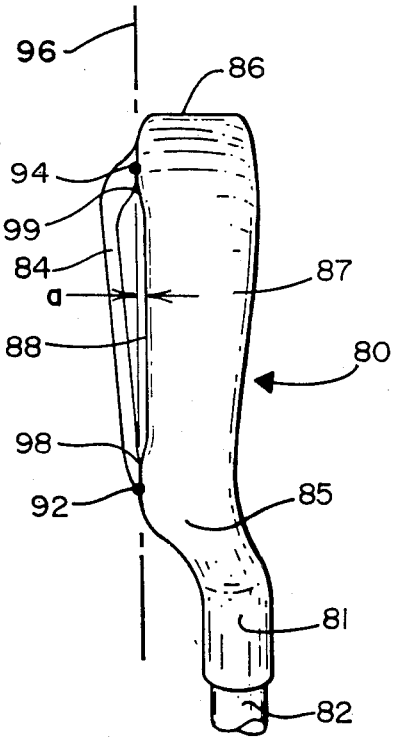
FIG. 14 is a bottom view of the club head shown in FIGS. 12 and 13.

Reference is now made to FIGS. 12, 13 and 14, which illustrate a perspective view, toe end elevational view and bottom view of a number 5 iron golf club head 80 of a correlated golf club set, with the club head 80 being configured in accordance with a second embodiment of the present invention. The club head 80 includes a hosel 81 connected in the known manner to the shaft 82. The hosel 81 is formed integrally with the head proper which includes the ball impacting face 83, back surface 84, heel portion 85, toe portion 86, and the sole 87. The club head 80 is preferably of the sole-weighted cavity backed configuration in the manner hereinbefore described. The trailing edge 88 of the sole 87 and the encircled lower back surface area 90 proximate thereto, as indicated by dashed line 91, are indented at least 1/16 of an inch, as indicated at "a", with the indentation extending longitudinally and substantially linearly intermediate the extreme opposite ends of the trailing edge which are designated at the points 92 and 94. The point 92 is the point where the downwardly and inwardly extending curvature of the heel portion 85 blends with the sole 87 and the point 94 is located where the curvature of the toe portion 86 blends with the sole. The indentation of the trailing edge 88 is in relationship with a substantially straight line 96 which contains both of the points 92 and 94.

As seen best in FIG. 13, the lower back surface area 90 slopes upwardly and inwardly from the indented trailing edge 88 and this, in conjunction with the indentation, allows a relatively large amount of club head material to be redistributed for mass concentration purposes.

As seen best in FIG. 14, the opposite ends of the linearly indented trailing edge 88 and the adjacent lower back surface area 90 are preferably spaced inwardly short distances from the extreme ends 92 and 94 of the trailing edge 88. This provides a land area 98 in the vicinity of the point 92 and a similar land area 99 in the vicinity of the point 94. These land areas 98 and 99 are the places where at least portions of the redistributed club head material are preferably located for mass concentration purposes.

Figure 15:
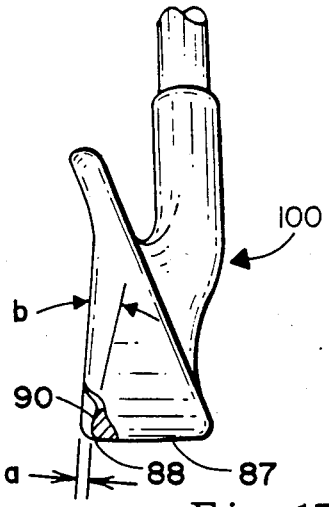
FIGS. 15 and 16 are a toe end elevational view and a bottom view, respectively, of a number 2 iron golf club head of a correlated set configured in accordance with the second embodiment of the present invention.
Figure 17:
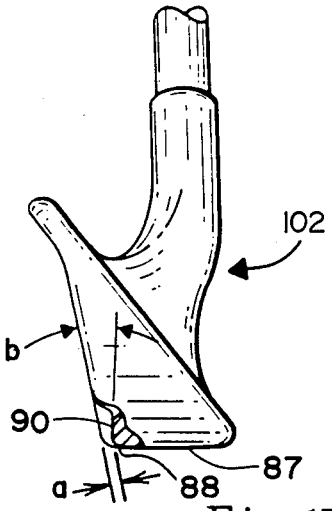
FIGS. 17 and 18 are a toe end elevational view and a bottom view, respectively, of a number 8 iron golf club head of a correlated set configured in accordance with the second embodiment of the present invention.
Figure 16:
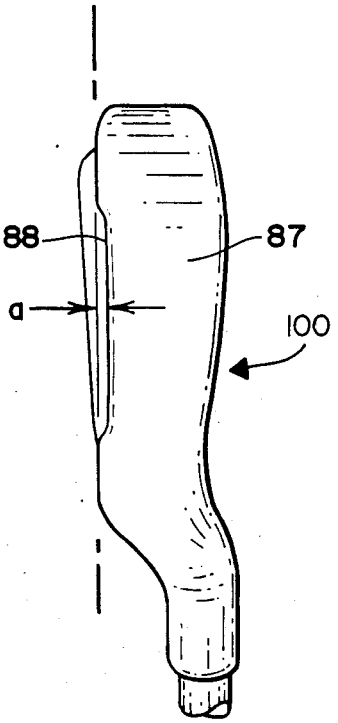
Figure 18:
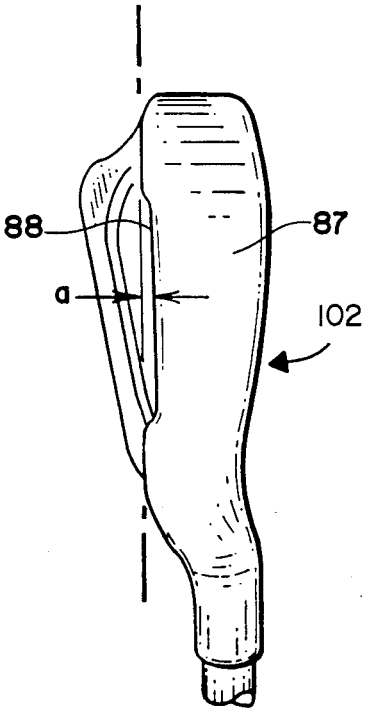

FIGS. 15 and 16 illustrate a toe end elevational view and a bottom view of a number 2 iron golf club head 100 of a correlated golf club set, and FIGS. 17 and 18 show similar views of a number 8 golf club head 102 of the correlated golf club set. Each of the club heads 100 and 102 are provided with the substantially linearly indented trailing edge of the sole and the adjacent lower back surface as hereinbefore fully described with reference to the number 5 iron golf club head 80 shown in FIGS. 12, 13 and 14.

Although particular embodiments of the invention have been described and illustrated herein, it is recognized that modifications and variations may readily occur to those skilled in the art. Consequently, it is intended that the claims be interpreted to cover such modifications and variations.

What I claim is:

1. An improved correlated set of iron-type golf clubs, each club having a head which includes a face for impacting a golf ball, a back surface, a heel portion, a toe portion and a sole, said sole having a trailing edge extending between said heel and toe portions, the improvement comprising at least a central portion of said trailing edge being indented toward said face at least 1/16 of an inch and having at least the lower portion of said back surface adjacent said indented trailing edge configured to conform to said indented trailing edge by sloping upwardly and inwardly from said indented trailing edge toward said face.

2. The improvement of claim 1 wherein the lower portion of said back surface slopes upwardly and inwardly from said trailing edge at an acute angle relative to the other portions of said back surface.

3. The improvement of claim 1 wherein the indentation of said trailing edge is of arcuately extending configuration.

4. The improvement of claim 1 wherein the indentation of said trailing edge is of substantially linearly extending configuration.

5. An improved correlated set of iron-type golf clubs, each having a head which includes a face for impacting a golf ball, a back surface, a heel portion, a toe portion and a sole, said sole having a trailing edge extending between said heel and toe portions, the improvement comprising at least a central portion of said trailing edge being indented at least 1/16 of an inch relative to a straight line which contains the extreme opposite ends of said trailing edge and having at least the lower back portion of said back surface adjacent said indented trailing edge being configured to conform to said indented trailing edge by sloping upwardly and inwardly from said indented trailing edge toward said face.

6. The improvement of claim 5 and further comprising the indentation of said trailing edge is of arcuately extending configuration.

7. The improvement of claim 6 and further comprising the total length of the arcuately extending indentation of said trailing edge being less than the total length of said trailing edge.

8. The improvement of claim 5 and further comprising the indentation of said trailing edge is of substantially linearly extending configuration.

9. The improvement of claim 8 and further comprising the total length of the substantially linearly extending indentation of said trailing edge being less than the total length of said trailing edge.

* * * * *